US010370935B2

(12) United States Patent
Kendall et al.

(10) Patent No.: US 10,370,935 B2
(45) Date of Patent: Aug. 6, 2019

(54) PACKER ASSEMBLY INCLUDING A SUPPORT RING

(71) Applicants: Alexander Morrison Kendall, Houston, TX (US); Guijun Deng, The Woodlands, TX (US); Nicholas Conner, Cypress, TX (US)

(72) Inventors: Alexander Morrison Kendall, Houston, TX (US); Guijun Deng, The Woodlands, TX (US); Nicholas Conner, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/650,233

(22) Filed: Jul. 14, 2017

(65) Prior Publication Data

US 2019/0017347 A1 Jan. 17, 2019

(51) Int. Cl.

| | |
|---|---|
| ***E21B 33/122*** | (2006.01) |
| ***E21B 33/129*** | (2006.01) |
| ***E21B 33/1295*** | (2006.01) |
| *E21B 33/127* | (2006.01) |

(52) U.S. Cl.

CPC ..... *E21B 33/12955* (2013.01); *E21B 33/122* (2013.01); *E21B 33/1292* (2013.01); *E21B 33/1272* (2013.01)

(58) Field of Classification Search

CPC ..... E21B 33/12955; E21B 33/122

See application file for complete search history.

(56) References Cited

U.S. PATENT DOCUMENTS

| | | | | |
|---|---|---|---|---|
| 2,726,722 | A | 12/1955 | Baker | |
| 2,767,795 | A | 10/1956 | Bush | |
| 2,797,759 | A | 7/1957 | Long et al. | |
| 2,885,009 | A | 5/1959 | Baker | |
| 2,921,633 | A * | 1/1960 | Baker | E21B 33/1216 277/338 |
| 2,945,541 | A | 7/1960 | Maly et al. | |
| 3,229,767 | A | 1/1966 | Carter | |
| 3,298,440 | A | 1/1967 | Current | |
| 3,313,553 | A | 4/1967 | Gastineau | |
| 3,343,607 | A | 9/1967 | Current | |
| 3,358,766 | A | 12/1967 | Current | |

(Continued)

FOREIGN PATENT DOCUMENTS

| | | |
|---|---|---|
| AU | 2015397127 B2 | 12/2016 |
| EP | 1197632 A2 | 4/2002 |

(Continued)

OTHER PUBLICATIONS

Notification of Transmittal of the International Search Report; PCT/US2018/050395; dated Jan. 2, 2019; 5 pages.

(Continued)

*Primary Examiner* — David J Bagnell
*Assistant Examiner* — Dany E Akakpo
(74) *Attorney, Agent, or Firm* — Cantor Colburn LLP

(57) ABSTRACT

A packer system includes a gauge ring, an expanding ring arranged adjacent to the gauge ring, a back-up ring, a packer element arranged adjacent to the back-up ring, and a support ring arranged between the back-up ring and the expanding ring. The support ring promotes radial outward expansion of the expanding ring.

6 Claims, 4 Drawing Sheets

(56) References Cited

U.S. PATENT DOCUMENTS

| | | | |
|---|---|---|---|
| 3,381,969 | A | 5/1968 | Crow et al. |
| 3,385,679 | A | 5/1968 | Current |
| 3,481,611 | A | 12/1969 | Stratton |
| 3,960,311 | A | 6/1976 | Griffiths |
| 4,204,690 | A | 5/1980 | Holland et al. |
| 4,349,204 | A | 9/1982 | Malone |
| RE31,933 | E | 7/1985 | Taylor et al. |
| 4,665,978 | A | 5/1987 | Luke |
| 4,753,444 | A | 6/1988 | Jackson et al. |
| 4,765,404 | A | 8/1988 | Bailey et al. |
| 4,852,394 | A | 8/1989 | Lazes |
| 4,892,144 | A | 1/1990 | Coone |
| 4,910,832 | A | 3/1990 | Schaub et al. |
| 5,027,894 | A | 7/1991 | Coone et al. |
| 5,161,806 | A | 11/1992 | Balsells |
| 5,311,938 | A | 5/1994 | Hendrickson et al. |
| 6,318,482 | B1 | 11/2001 | Fidtje |
| 6,431,274 | B1 | 7/2002 | Tedham et al. |
| 6,513,600 | B2 | 2/2003 | Ross |
| 6,581,682 | B1 | 6/2003 | Parent et al. |
| 6,598,672 | B2 | 7/2003 | Bell et al. |
| 7,124,826 | B2 | 10/2006 | Simpson |
| 7,178,601 | B2 | 2/2007 | Burge |
| 7,273,110 | B2 | 9/2007 | Pedersen et al. |
| 7,306,034 | B2 | 12/2007 | Garcia |
| 7,341,110 | B2 | 3/2008 | Doane et al. |
| 7,665,516 | B2 | 2/2010 | Roberts et al. |
| 7,708,080 | B2 | 5/2010 | Conaway et al. |
| 8,205,671 | B1 | 6/2012 | Branton |
| 8,276,678 | B2 | 10/2012 | Burnett et al. |
| 8,327,929 | B2 | 12/2012 | Reid et al. |
| 8,469,088 | B2 | 6/2013 | Shkurti et al. |
| 8,479,809 | B2 | 7/2013 | Farquhar |
| 8,701,787 | B2 | 4/2014 | Shkurti et al. |
| 8,839,874 | B2 | 9/2014 | Bishop et al. |
| 9,140,094 | B2 | 9/2015 | Lee et al. |
| 2002/0043368 | A1 | 4/2002 | Bell et al. |
| 2003/0037932 | A1 | 3/2003 | Guillory et al. |
| 2003/0226659 | A1 | 12/2003 | Smith et al. |
| 2004/0134659 | A1 | 7/2004 | Hoffman et al. |
| 2006/0289173 | A1 * | 12/2006 | Conaway ..... E21B 33/1216 166/387 |
| 2007/0125532 | A1 | 6/2007 | Murray et al. |
| 2007/0200299 | A1 | 8/2007 | Kunz |
| 2007/0256827 | A1 | 11/2007 | Guerrero et al. |
| 2007/0261863 | A1 | 11/2007 | MacLeod et al. |
| 2008/0041583 | A1 | 2/2008 | Angman et al. |
| 2008/0061510 | A1 | 3/2008 | Li et al. |
| 2008/0190600 | A1 | 8/2008 | Shkurti et al. |
| 2009/0065191 | A1 | 3/2009 | Reid et al. |
| 2009/0159265 | A1 | 6/2009 | Freyer |
| 2009/0255690 | A1 | 10/2009 | Conner et al. |
| 2010/0038074 | A1 | 2/2010 | Patel |
| 2010/0186970 | A1 | 7/2010 | Burnett |
| 2010/0294485 | A1 | 11/2010 | Lynde et al. |
| 2011/0101615 | A1 | 5/2011 | Clarke et al. |
| 2011/0297368 | A1 | 12/2011 | Lembcke |
| 2012/0018143 | A1 | 1/2012 | Lembcke |
| 2012/0037355 | A1 | 2/2012 | Bishop et al. |
| 2012/0073830 | A1 | 3/2012 | Lembcke et al. |
| 2012/0133098 | A1 | 5/2012 | Farquhar |
| 2012/0217025 | A1 | 8/2012 | Shkurti et al. |
| 2012/0305236 | A1 | 12/2012 | Gouthaman |
| 2013/0147120 | A1 | 6/2013 | O'Malley |
| 2013/0213672 | A1 | 8/2013 | Nutley et al. |
| 2013/0306330 | A1 | 11/2013 | Bishop et al. |
| 2014/0034335 | A1 | 2/2014 | Nutley et al. |
| 2014/0262351 | A1 | 9/2014 | Derby |
| 2014/0290946 | A1 | 10/2014 | Nguyen et al. |
| 2015/0308214 | A1 | 10/2015 | Bilansky et al. |
| 2015/0354313 | A1 | 12/2015 | McClinton et al. |
| 2016/0369586 | A1 | 12/2016 | Morehead et al. |
| 2017/0191340 | A1 | 7/2017 | Dent et al. |
| 2018/0023366 | A1 | 1/2018 | Deng et al. |
| 2018/0298716 | A1 | 10/2018 | Cayson et al. |
| 2018/0298718 | A1 | 10/2018 | Cayson et al. |
| 2018/0320473 | A1 | 11/2018 | Xu et al. |
| 2019/0040710 | A1 | 2/2019 | Deng et al. |
| 2019/0078413 | A1 | 3/2019 | Kendall et al. |

FOREIGN PATENT DOCUMENTS

| | | | |
|---|---|---|---|
| WO | 2006046075 | A2 | 5/2006 |
| WO | 2006121340 | A1 | 11/2006 |
| WO | 2009074785 | A2 | 6/2009 |
| WO | 2013128222 | A1 | 9/2013 |

OTHER PUBLICATIONS

Notification of Transmittal of the International Search Report and the Written Opinion of the International Searching Authority, or the Declaration; PCT/US2018/027359; dated Aug. 1, 2018; 11 pages.

Notification of Transmittal of the International Search Report and the Written Opinion of the International Searching Authority, or the Declaration; PCT/US2018/041880; dated Nov. 21, 2018; 13 pages.

* cited by examiner

PACKER ASSEMBLY INCLUDING A SUPPORT RING

BACKGROUND

Resource exploration and recovery systems often employ packers along a tubing string. The packers creates zones in a formation that may be isolated from one another. Typically, the packer is mounted to an outer surface of a tubular forming a portion of the tubing string. The tubing string is run into the formation to a desired depth and the packer is activated. In many cases, the packer is activated by a shifting tool. A ring, arranged on one side of the packer, is shifted toward a ring that may be constrained on an opposite side. The shifting of the ring causes the packer to axially compress and radially expand. Generally, a back-up ring is employed to limit axial excursion of the packer. The back-up ring, under certain applications, is prone to shearing, causing the packer to fail.

SUMMARY

A packer system includes a gauge ring, an expanding ring arranged adjacent to the gauge ring, a back-up ring, a packer element arranged adjacent to the back-up ring, and a support ring arranged between the back-up ring and the expanding ring. The support ring promotes radial outward expansion of the expanding ring.

A resource exploration and recovery system includes a surface system, and a downhole system including a string of tubulars. At least one of the string of tubulars supports a packer system including a gauge ring, an expanding ring arranged adjacent to the gauge ring, a back-up ring, a packer element arranged adjacent to the back-up ring, and a support ring arranged between the back-up ring and the expanding ring. The support ring promotes radial outward expansion of the expanding ring.

A method of setting a packer includes shifting a back-up ring toward an expanding ring, radially outwardly expanding the expanding ring, urging a support ring arranged between the back-up ring and the expanding ring to further radially outwardly expand the expanding ring, and establishing a selected gap between a radial outer surface of the expanding ring and an inner surface of a wellbore with the support ring.

BRIEF DESCRIPTION OF THE DRAWINGS

Referring now to the drawings wherein like elements are numbered alike in the several Figures.

DETAILED DESCRIPTION

Figure 1:
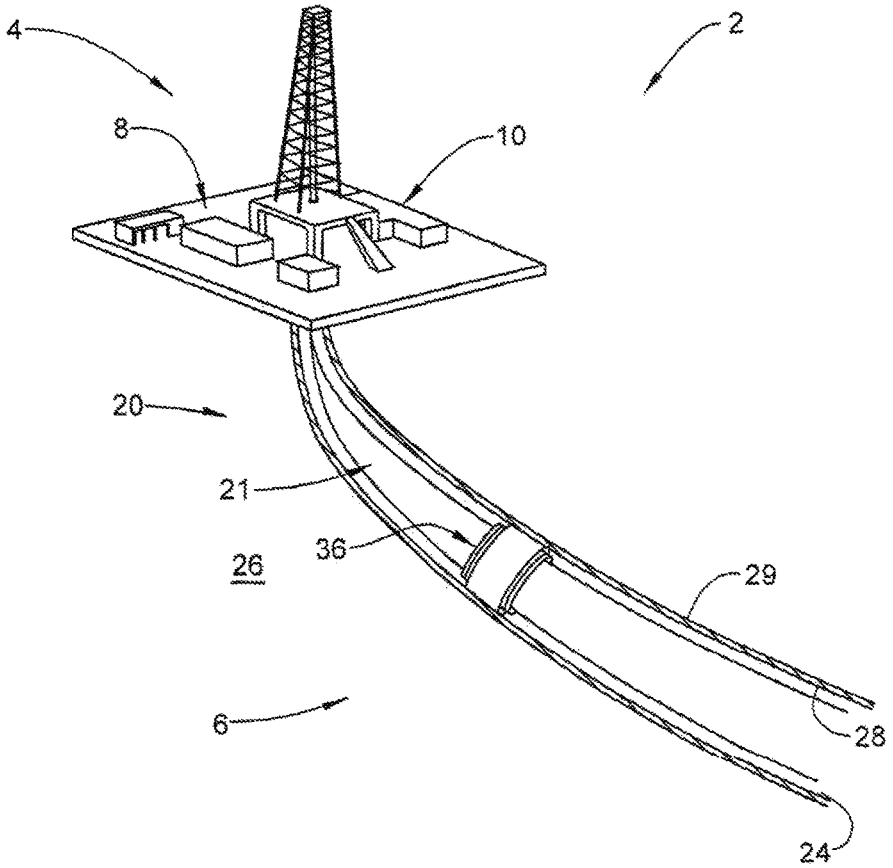
FIG. 1 depicts a resource exploration and recovery system having a packer assembly including a support ring, in accordance with an exemplary embodiment.

A resource exploration and recovery system, in accordance with an exemplary embodiment, is indicated generally at 2, in FIG. 1. Resource exploration and recovery system 2 should be understood to include well drilling operations, resource extraction and recovery, $CO_2$ sequestration, and the like. Resource exploration and recovery system 2 may include a surface system 4 operatively and fluidically connected to a downhole system 6. Surface system 4 may include pumps 8 that aid in completion and/or extraction processes as well as fluid storage 10. Fluid storage 10 may contain a gravel pack fluid or slurry (not shown) or other fluid which may be introduced into downhole system 6. Surface system 4 may also include a control system 12 that may monitor and/or activate one or more downhole operations.

Downhole system 6 may include a downhole string 20 formed from a plurality of tubulars, one of which is indicated at 21 that is extended into a wellbore 24 formed in formation 26. Wellbore 24 includes an annular wall 28 that may be defined by a wellbore casing 29 provided in wellbore 24. Of course, it is to be understood, that annular wall 28 may also be defined by formation 26. Downhole string 20 may include a packer assembly 36 that selectively engages annular wall 28 to establish a downhole zone.

Figure 2:
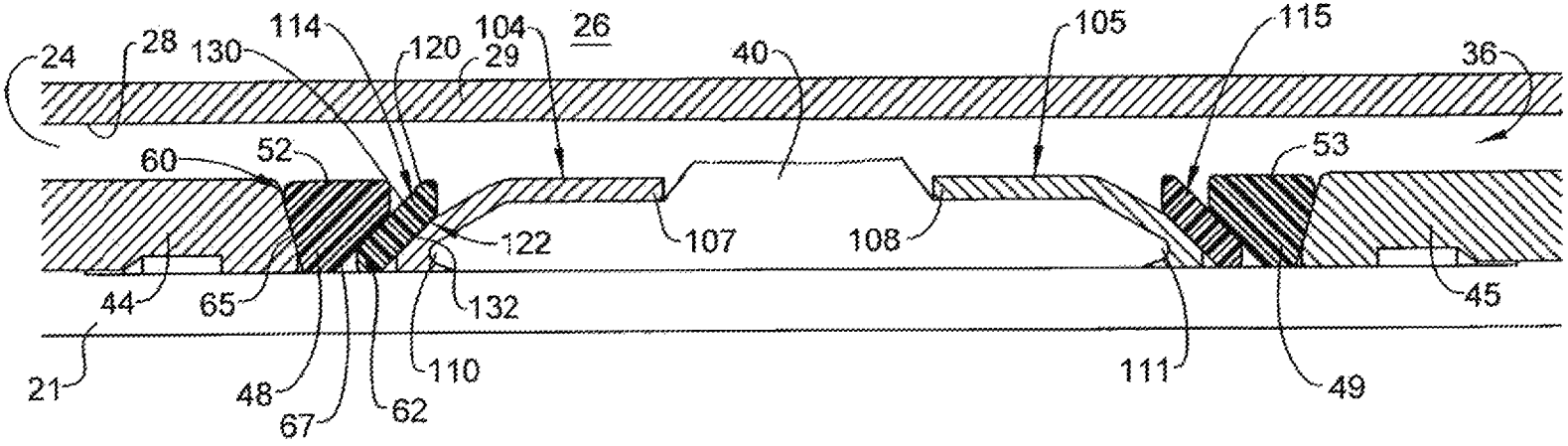
FIG. 2 depicts the packer assembly of FIG. 1.
Figure 3:
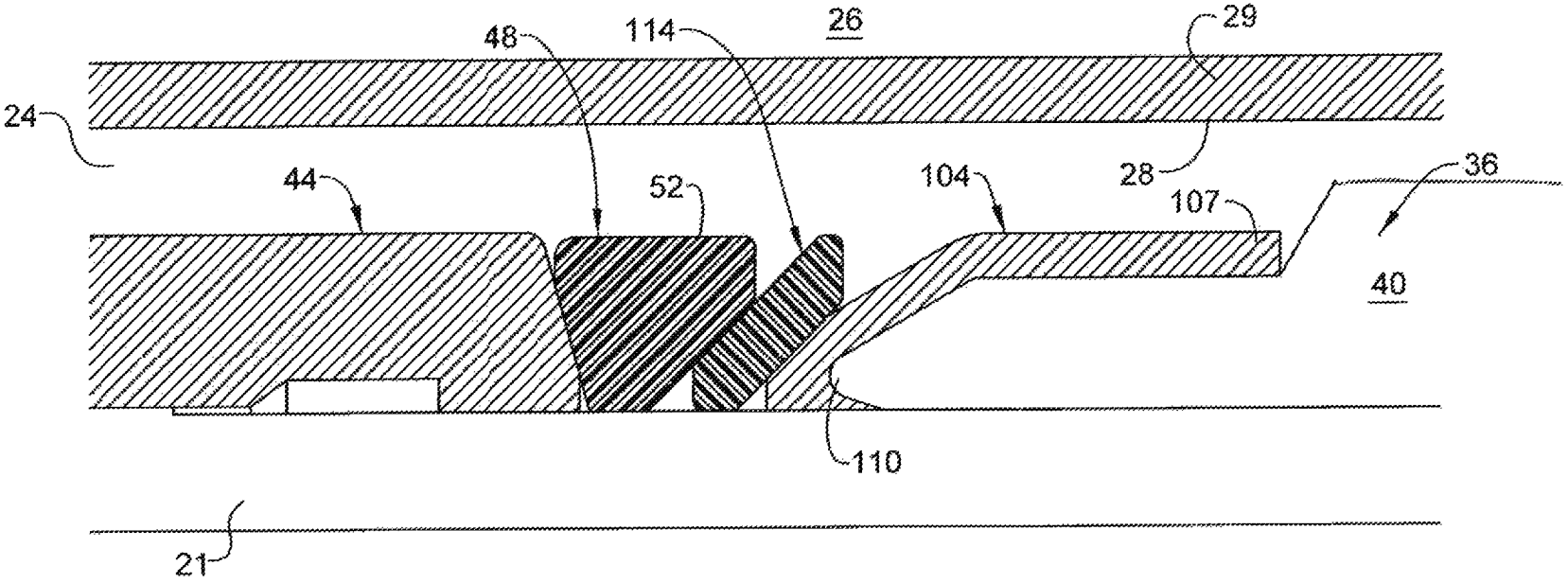
FIG. 3 is a partial view of the packer assembly of FIG. 2 showing a packer in a non-deployed configuration.
Figure 4:
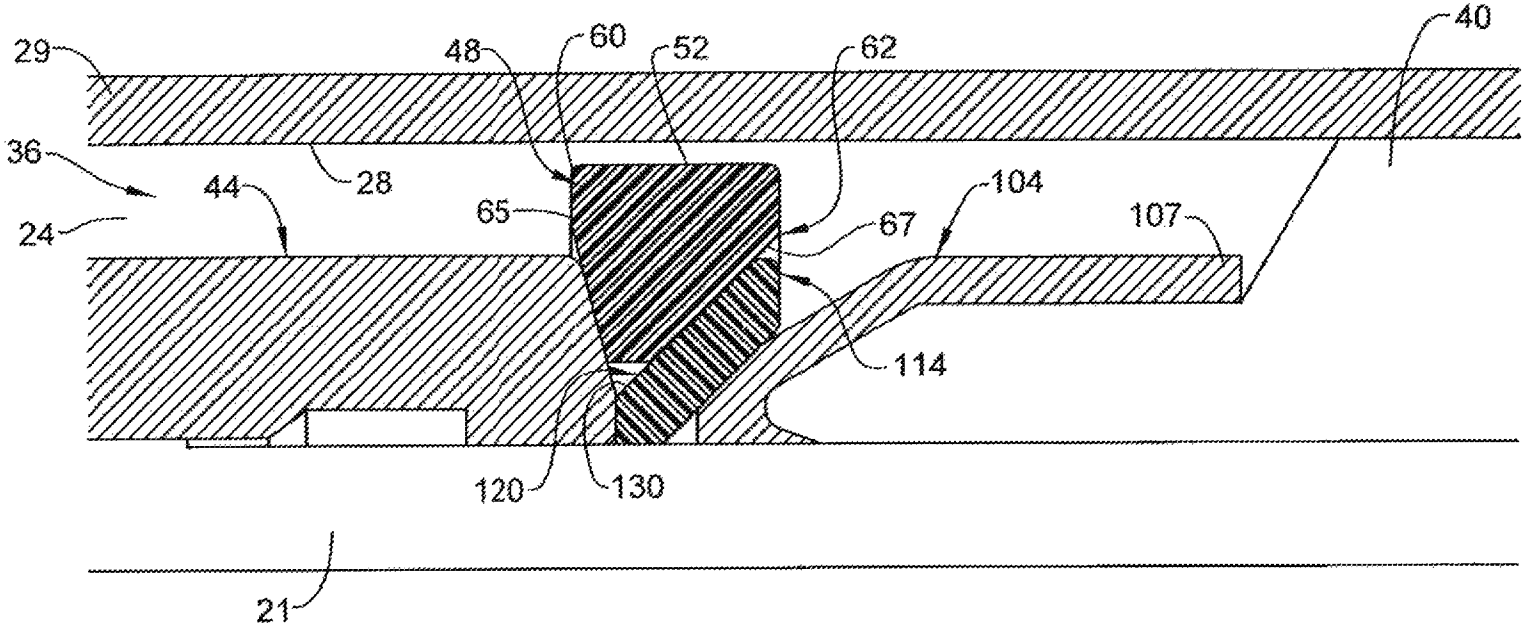
FIG. 4 depicts the c-ring of FIG. 3 in a deployed configuration.

With reference to FIGS. 2 and 3, packer assembly 36 includes an a packer element in the form of an elastomeric member 40 that is selectively radially outwardly expanded into contact with annular wall 28 of wellbore casing 29. It should be understood that elastomeric member 40 may also be radially outwardly expanded into contact with an annular wall (not separately labeled) defined by formation 26. Packer assembly 36 also includes a first gauge ring 44 and a second gauge ring 45. One of first and second gauge rings 44, 45 may be fixedly mounted relative to tubular 21 while another of gauge rings 44, 45 may be shiftable and thereby define an activation ring.

Packer assembly 36 is also shown to include a first expanding ring that may take the form of a first c-ring 48 and a second expanding ring that may take the form of a second c-ring 49. First and second c-rings 48, 49 are arranged between corresponding ones of first and second gauge rings 44, 45 and elastomeric member 40. Each c-ring 48, 49 includes a radially outwardly facing surface 52 and 53. Reference will now follow to FIG. 3 in describing first c-ring 48 with an understanding that second c-ring 49 may include similar structure. First c-ring 48 also includes a first angled surface 60 and second angled surface 62. First angled surface 60 is defined by a first angle 65 and second angled surface 62 is defined by a second angle 67. First angle 65 may be distinct from second angle 67 and selected to establish a desired travel of first c-ring 48. Of course, it should be understood that first angle 65 and second angle 67 may be substantially similar.

Additionally, packer assembly 36 includes a first back-up ring 104 and a second backup ring 105. Each back-up ring 104, 105 includes a corresponding axial end 107, 108 defining first and second pockets 110 and 111 receptive of a portion of elastomeric member 40. In operation, one of gauge rings 44, 45 is shifted towards another of gauge rings 44, 45, causing elastomeric member 40 to expand axially outwardly.

In accordance with an exemplary aspect, packer assembly 36 includes a first spacer or support ring 114 and a second spacer or support ring 115. First support ring 114 is arranged between first back-up ring 104 and first c-ring 48, and second support ring 115 is arranged between second back-up ring 105 and second c-ring 49. Reference will follow to FIG. 3 in describing first support ring 114, with an understanding that second support ring 115 may include similar structure. First support ring 114 includes a first angled surface portion 120 defined by a third angle 130 and a second angled surface portion 122 defined by a fourth angle 132. As shown, first angled surface portion 120 nests against second angled surface 62 of first c-ring 48. In accordance with an exemplary aspect, second angle 67 and third angle 130 may define complimentary angles. It should be understood however that some differences may exist between second angle 67 and third angle 130.

In accordance with an exemplary aspect, first and second support rings 114 and 115 act upon corresponding ones of first and second c-rings 48 and 49 to establish a desired gap between first and second radially outward surfaces 52 and 53 and annular wall 28 of wellbore 24. The particular size of the gap may vary and may depend on tubular diameter, wellbore diameter and/or combinations thereof. The gap may be smaller than otherwise achievable with a c-ring alone. In this manner, packer assembly may be utilized in a larger array of applications without concern that a back-up ring may shear or otherwise bend and shift over or toward a corresponding c-ring.

Set forth below are some embodiments of the foregoing disclosure:

Embodiment 1

A packer system including a gauge ring, an expanding ring arranged adjacent to the gauge ring, a back-up ring, a packer element arranged adjacent to the back-up ring, and a support ring arranged between the back-up ring and the expanding ring, the support ring promoting radial outward expansion of the expanding ring.

Embodiment 2

The packer system as in any prior embodiment, wherein the expanding ring includes a first angled surface defining a first angle and a second angled surface defining a second angle.

Embodiment 3

The packer system as in any prior embodiment, wherein the first angle is distinct from the second angle.

Embodiment 4

The packer system as in any prior embodiment, wherein the support ring includes a first angled surface portion defining a third angle and a second angled surface portion defining a fourth angle.

Embodiment 5

The packer system as in any prior embodiment, wherein the first angled surface portion nests against the second angled surface.

Embodiment 6

The packer system as in any prior embodiment, wherein the third angle and the second angle are complimentary angles.

Embodiment 7

A resource exploration and recovery system including a surface system, and a downhole system including a string of tubulars, at least one of the string of tubulars supporting a packer system including a gauge ring, an expanding ring arranged adjacent to the gauge ring, a back-up ring, a packer element arranged adjacent to the back-up ring, and a support ring arranged between the back-up ring and the expanding ring, the support ring promoting radial outward expansion of the expanding ring.

Embodiment 8

The resource exploration and recovery system as in any prior embodiment, wherein the expanding ring includes a first axial end and a second axial end, the first axial end having a first angled surface defining a first angle and the second axial end including a second angled surface defining a second angle.

Embodiment 9

The resource exploration and recovery system as in any prior embodiment, wherein the first angle is distinct from the second angle.

Embodiment 10

The resource exploration and recovery system as in any prior embodiment, wherein the support ring includes a first angled surface portion defining a third angle and a second angled surface portion defining a fourth angle.

Embodiment 11

The resource exploration and recovery system as in any prior embodiment, wherein the first angled surface portion nests against the second angled surface.

Embodiment 12

The resource exploration and recovery system as in any prior embodiment, wherein the third angle and the second angle are complimentary angles.

Embodiment 13

A method of setting a packer including shifting a back-up ring toward an expanding ring, radially outwardly expanding the expanding ring, urging a support ring arranged between the back-up ring and the expanding ring to further radially outwardly expand the expanding ring, and establishing a selected gap between a radial outer surface of the expanding ring and an inner surface of a wellbore with the support ring.

Embodiment 14

The method as in any prior embodiment, further including constraining axial movement of the expanding ring with a gauge ring arranged axially outwardly of the packer.

Embodiment 15

The method as in any prior embodiment, further including shifting the support ring into contact with the gauge ring.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A packer system comprising:

a tubular having a surface;

a gauge ring provided on the tubular;

an expanding ring arranged adjacent to the gauge ring, the expanding ring including a first angled surface abutting the gauge ring and a second, opposing angled surface having a first angled portion that extends at a first angle relative to the surface and a second angled portion that extends at a second angle relative to the surface, the first angle being non-perpendicular relative to the surface;

a back-up ring including a first surface section and a second surface section, the first surface section extending at a non-perpendicular angle relative to the surface;

a packer element arranged adjacent to the back-up ring, the first surface section and the second surface section encapsulating a portion of the packer element; and a support ring arranged axially between the back-up ring and the expanding ring, the support ring including a first angled surface portion that is complimentary to the first angle and a second angled surface portion that is complimentary to the first angled surface section, the support ring promoting radial outward expansion of the expanding ring.

2. The packer system according to claim 1, wherein the first angle is distinct from the second angle.

3. The packer system according to claim 1, wherein the first angled surface portion nests against the second angled surface.

4. A resource exploration and recovery system comprising:

a surface system; and a downhole system including a string of tubulars, at least one of the string of tubulars including a surface supporting a packer system comprising:

a gauge ring provided on the string of tubulars;

an expanding ring arranged adjacent to the gauge ring, the expanding ring including a first angled surface abutting the gauge ring and a second, opposing angled surface having a first angled portion that extends at a first angle relative to the surface and a second angled portion that extends at a second angle relative to the surface, the first angle being non-perpendicular relative to the surface;

a back-up ring including a first surface section and a second surface section, the first surface section extending at a non-perpendicular angle relative to the surface;

a packer element arranged adjacent to the back-up ring, the first surface section and the second surface section encapsulating a portion of the packer element; and a support ring arranged axially between the back-up ring and the expanding ring, the support ring including a first angled surface portion that is complimentary to the first angle and a second angled surface portion that is complimentary to the first angled surface section, the support ring promoting radial outward expansion of the expanding ring.

5. The resource exploration and recovery system according to claim 4, wherein the first angle is distinct from the second angle.

6. The resource exploration and recovery system according to claim 4, wherein the first angled surface portion nests against the second angled surface.

* * * * *